US006996351B2

(12) United States Patent
Felix

(10) Patent No.: US 6,996,351 B2
(45) Date of Patent: Feb. 7, 2006

(54) SYSTEM AND METHOD FOR USING A PRINTER TO COLLATE A DOCUMENT

(75) Inventor: Leonard Felix, Camas, WA (US)

(73) Assignee: Sharp Electronics Corp., Mahwah, NJ (US)

( * ) Notice: Subject to any disclaimer, the term of this patent is extended or adjusted under 35 U.S.C. 154(b) by 118 days.

(21) Appl. No.: 10/750,732

(22) Filed: Jan. 2, 2004

(65) Prior Publication Data

US 2005/0147427 A1 Jul. 7, 2005

(51) Int. Cl.
*G03G 15/00* (2006.01)

(52) U.S. Cl. ..... 399/82; 399/407

(58) Field of Classification Search ..... 399/75, 399/76, 80, 81, 82, 407, 77, 85; 358/1.15, 358/1.8

See application file for complete search history.

(56) References Cited

U.S. PATENT DOCUMENTS

| | | | | |
|---|---|---|---|---|
| 4,727,402 | A * | 2/1988 | Smith | 399/368 |
| 5,299,021 | A | 3/1994 | Gartner | 358/401 |
| 5,480,135 | A | 1/1996 | Nagane et al. | 271/176 |
| 5,655,208 | A | 8/1997 | Sahay et al. | 399/397 |
| 6,041,200 | A | 3/2000 | Glass et al. | 399/82 |
| 6,049,391 | A * | 4/2000 | Farrell | 358/1.15 |
| 6,398,481 | B2 | 6/2002 | Chen | 414/791.2 |
| 6,579,059 | B2 | 6/2003 | Chen | 414/791.2 |
| 6,646,758 | B1 * | 11/2003 | Anderson et al. | 358/1.15 |
| 2004/0190066 | A1 * | 9/2004 | Holzwarth et al. | 358/1.18 |

* cited by examiner

*Primary Examiner*—Hoan Tran
(74) *Attorney, Agent, or Firm*—Law Office of Gerald Maliszewski; Gerald Maliszewski

(57) ABSTRACT

A system and method are provided for using a printer to collate a document from preprinted pages. The method includes: loading document sections in at least one printer input media tray, although a plurality of document sections may be loaded into a corresponding plurality of input media trays; entering a collation program; and, creating a collated document from input media tray document sections, in response to the collation program. Entering a collation program includes: accessing a menu from a collation driver application; populating fields in the menu; and, sending collation commands to a printer collation controller in response to the populated fields. More specifically, accessing a menu from a collation driver application includes accessing a menu using a user interface (UI). The UI may be the front panel of the printer, a client device (personal computer or network-connected server) connected to the printer, or a web page connected to the printer.

23 Claims, 4 Drawing Sheets

SYSTEM AND METHOD FOR USING A PRINTER TO COLLATE A DOCUMENT

BACKGROUND OF THE INVENTION

1. Field of the Invention

This invention generally relates to printer and copier systems and, more particularly, to a system and method for using conventional printer or copier hardware for paper document collation.

2. Description of the Related Art

FIG. 1 is a depiction of an exemplary xerographic copier/printer (prior art). As noted in U.S. Pat. No. 5,665,208, there are two input paper trays 21 shown in paper input module 22. Marking module 23 includes a photoreceptor drum or belt 1 and stations acting thereon for respectively charging 2, exposing 3, developing multiple colors 4, 5, 6, 7, transferring 11, cleaning 8 and erasing 9. Transferred images are fixed to the paper by passing the sheet through fusing station 10. The copier/printer is adapted to provide mixed one-sided and two-sided page-sequential copy sets comprised of black and white and color images. Sheet feeding is controlled by an apparatus controller 29, typically a microprocessor. Marking module 23 includes two registration wait gates, a first registration wait gate 27 and a second registration wait gate 30, a transfer drum 13 with two registration grippers 12, a two-sided copy gate 14, a two-sided copy inverter 15, exit inverter gates 17 and an exit inverter 16. Productivity module 24 contains five intermediate sorter bins 18. Output stacker module 25 contains two elevator stackers 19 and a bypass transport 20.

Clean copy sheets are first fed from one of the input paper trays 21*a* and 21*b* to the first to registration wait gate 27. The two paper trays can hold any type of copy paper. Typically, one tray holds one type of paper, such as, but not limited to standard 8½"×11", while the other tray holds another type, such as, but not limited to, A4. At the appropriate time, the sheet is re-fed to registration gripper 12*a* where the sheet is gripped and transported through xerographic transfer station 11 where upon the transfer of a monochrome toner image from photoreceptor drum or belt 1 to one side of the sheet occurs. The copy sheet is mechanically registered against first registration gripper 12*a* and held against transfer drum 13 by static electricity forces. If a monochrome image is desired, first registration gripper 12*a* is released after transfer and the sheet passes into fusing station 10 for image fixing. Unless two-sided copying is detected by the apparatus controller 29, the copy sheet is then advanced from the transfer station 11 to the second output port 26*b*. For multiple revolution, multiple pass copying, the color copying process is accomplished such that the cyan, magenta, yellow, and black images are separately transferred onto a sheet of copy paper and overlaid on each other sequentially during multiple revolutions of the photoreceptor drum 1 at the transfer station 11.

In the event a two-sided copy is desired, the sheet is transported upward into two-sided copy inverter 15 and re-fed to second registration wait gate 30. At the appropriate time, the sheet is re-fed to first registration gripper 12*a* or second registration gripper 12*b*. The respective grippers are on substantially opposite diametric ends of each other. As a result of this configuration, the respective registration grippers provide the registration means for holding more than one sheet of copy paper at a time and assisting in the movement through transfer station 11. Each gripper can grip, hold, and move a sheet of copy paper. When a sheet is so gripped it is gripped and transported through xerographic transfer station 11 one or more times where upon the transfer of a monochrome or colored toner image from photoreceptor drum or belt 1 to the second side of the sheet occurs. Upon complete image transfer, first registration gripper 12*a* is released after transfer and the sheet passes into fusing station 10 for second side image fixing.

Exit inverter gate 17 can now be employed to invert the sheet if an image side up copy sheet orientation is desired. In the event exit inverter gate 17 is closed, the copy sheet will be deflected downward into exit inverter 16 and re-fed to the second output port 26*b*. In the event the exit inverter gate 17 is open, the copy sheet will bypass the exit inverter 16, will be inverted, and then be acquired by the second output port 26*b* for final exit or for transport into one or more intermediate sorter bins 18 and/or one or more stacker modules 25.

It would be advantageous if the multiple input trays of a printer or copier could be used to accept preprinted sheets, and the printer used to collate a document using the preprinted sheets.

It would be advantageous if the above-mentioned collating printer could also collate sheets, printed in real-time, with the preprinted sheets.

SUMMARY OF THE INVENTION

This present invention permits a multi-tray printing device such as a copier or laser printer, to be used as a collator and/or a finisher by placing preprinted paper in the various input trays, setting tray order, and the number of pages to be pulled from each tray, to create a collated set. Further, the user may select any available finishing option for application to each collated set. For example, the number of total collated sets to be created may also be specified.

Accordingly, a method is provided for using a printer to collate a document from preprinted pages. The method comprises: loading document sections in at least one printer input media tray, although a plurality of document sections may be loaded into a corresponding plurality of input media trays; entering a collation program; and, creating a collated document from input media tray document sections, in response to the collation program.

Entering a collation program includes: accessing a menu from a collation driver application; populating fields in the menu; and, sending collation commands to a printer collation controller in response to the populated fields. More specifically, accessing a menu from a collation driver application includes accessing a menu using a user interface (UI). The UI may be the front panel of the printer, a client device (personal computer or network-connected server) connected to the printer, or a web page connected to the printer.

The collation commands may be sent as printer description language (PDL) commands, such as printer job language (PJL), printer control language (PCL), or PostScript (PS) commands. The collation program may additionally be used to select collation options such as the number of collated documents, the tray order, the number of sheets pulled in response to selecting a tray, media side selection, stapling, hole punching, and/or folding.

Additional details of the above-described method, and a collation-enabled printer for collating a document from preprinted pages, are presented below.

DETAILED DESCRIPTION OF THE PREFERRED EMBODIMENTS

Figure 2A:
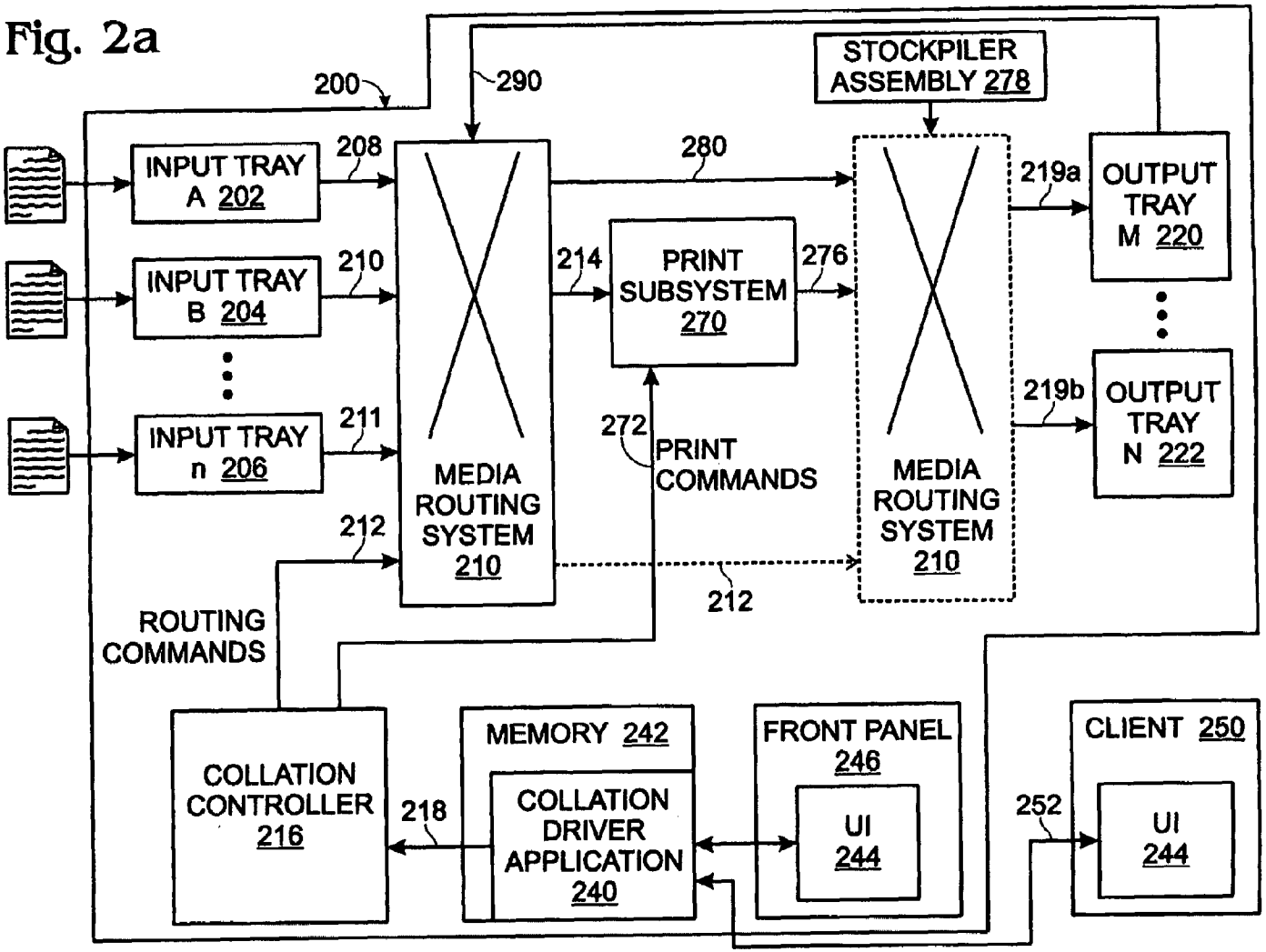
FIG. 2*a* is a schematic block diagram of the present invention collation-enabled printer for collating a document from preprinted pages.

FIG. 2*a* is a schematic block diagram of the present invention collation-enabled printer for collating a document from preprinted pages. The printer 200 comprises at least one input media tray having an interface to accept a document section for loading. Typically, a document is a preprinted sheet. However, "blank" document sections may be useful in some collation jobs. Shown are input tray A (202), input tray B (204), and input tray n (206). The invention is not limited to any particular number of trays. Each tray 202/204/206 has a respective interface (paper path) 208/210/211 to supply a corresponding loaded document section for collation. The input media trays 202/204/206 can accept either paper or plastic sheets.

As used herein, a printer is a device that generates images on a media in response to front panel or other electronic commands. A printer (as used herein) can be a laser or ink jet printer, a fax machine, a copier, or a multifunctional peripheral (MFP) device. A laser printer is used to explain the invention, although the invention is not limited to any particular image fixation process.

A media routing system 210 has an interface to accept media from the input media trays 202/204/206 and an input on line 212 to accept routing commands. The media routing system 210 has an output on line 214 to supply the media in an order responsive to the routing commands. Note that although line 214 is represented as a single line (paper path), in other aspects line 214 represents multiple paper paths. A collation controller 216 has an interface on line 218 to accept collation commands and an interface on line 212 to supply routing commands that are responsive to the collation commands. The media routing system 210 is represented as a switching crossbar. At least one output media tray has an interface on line (paper path) 219 for receiving the collated document. Shown are output tray M (220) and output tray N (222), connected on lines 219*a* and 219*b,* respectively. The printer 200 is not limited to any particular number of output trays.

Figure 1:
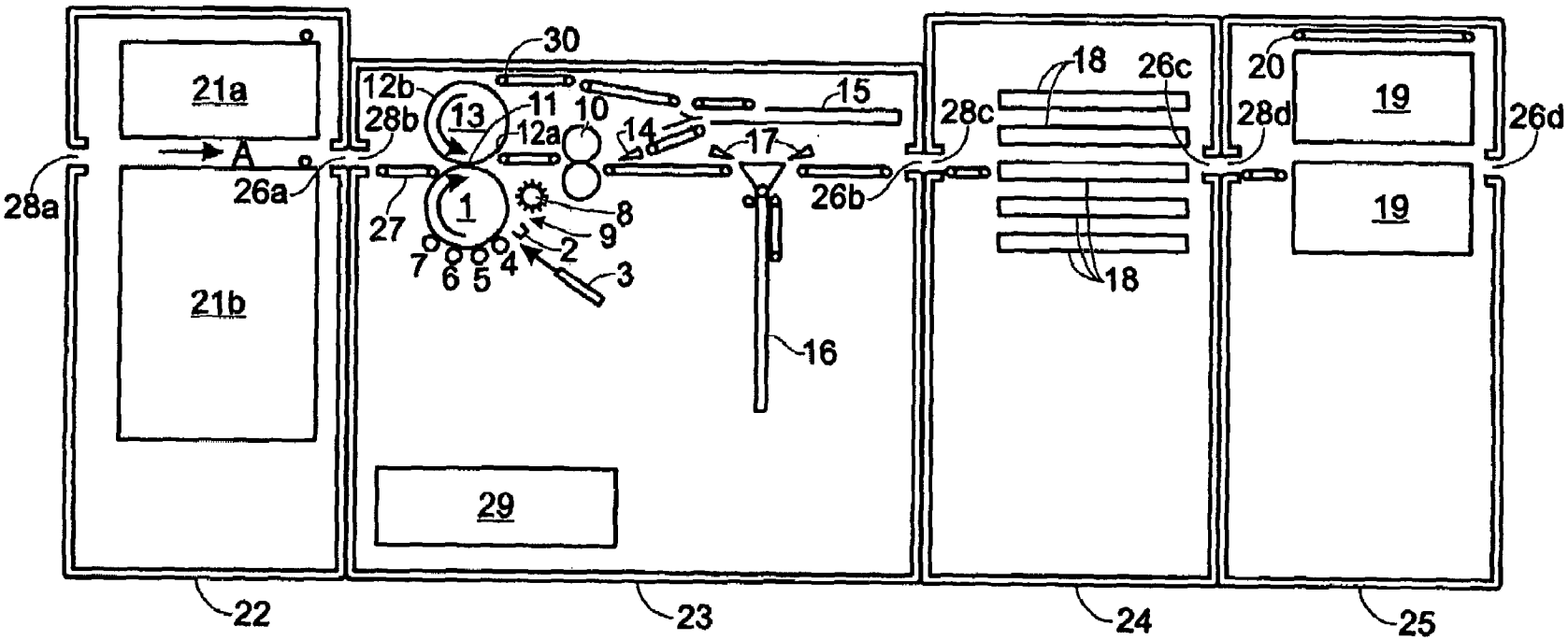
Fig. 1 (PRIOR ART)
FIG. 1 is a depiction of an exemplary xerographic copier/printer (prior art).

Referring briefly to FIG. 1, in a simple aspect of the invention, the media routing system is similar to the sheet-feeding control apparatus 29, except modified to accept the collation program, and direct the feeding of sheets in response to the collation program. In more complex aspects of the system, described below, the media routing may additionally include elements of the marking module section 23, such as the inverter 15.

Returning to FIG. 2*a,* the printer 200 may further comprise a collation driver application. The collation driver application is a software program. That is, the collation driver application is a list of microprocessor instructions. In one aspect, the collation driver application 240 is manipulated from a memory 242. Also shown is a user interface (UI) 244. Typically, a user interface includes a display or readout for presenting user prompts, as well as a mouse, keyboard, keypad, or the like for accepting input commands from a user. More specifically, the UI 244 accesses a collation menu from the collation driver application 240 and populates fields in the menu in response to user commands. In response to the collation menu, the collation driver application 240 supplies collation commands to the collation controller 216.

In one aspect, the UI 244 is the printer front panel 246. In another aspect, the UI is associated with a connected client device 250, which may be either locally or network-connected (through a server, not shown) to the printer 200 on line 252. If the collation driver application 240 is embedded with the printer 200, and the UI 244 resides with the client 250, then the UI interface prompts and responses (commands) are relayed between the printer 200 and the client 250 on line 252.

Figure 2B:
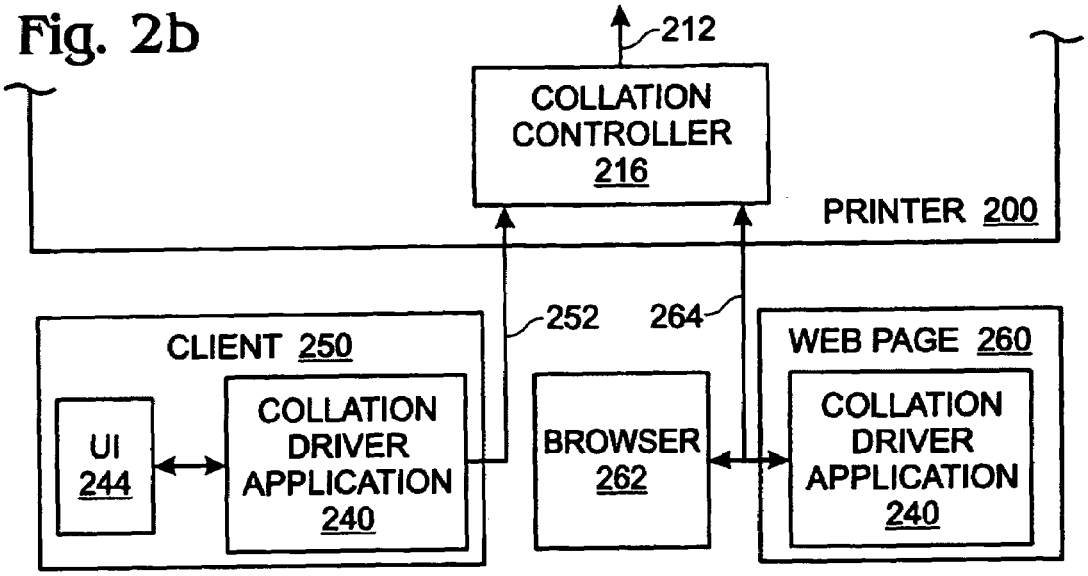
FIG. 2*b* is an aspect of the printer of FIG. 2*a* showing alternate collation driver application residencies.

FIG. 2*b* is an aspect of the printer of FIG. 2*a* showing alternate collation driver application residencies. If the collation driver application 240 and UI 244 are embedded with the client 250, then the client 250 sends collation commands to the collation controller 216 on line 252.

In another aspect, the UI is associated with a connected web page 260. In the case of the web page, the UI 244 may be considered to a combination of a client browser 262 that is network-connected to the web page on line 264. The collation driver application 240 may be embedded in the web page 260 (as shown), in which case the web page 260 sends collation commands to the collation controller 216 on line 266. Alternately, the collation driver application 240 is embedded in the printer 200 (see FIG. 2*a*), and web page merely relays UI prompts and response between the client browser 262 and the printer 200. In another aspect, not shown, the collation driver application 240 resides in a printer-connected server.

With respect to either FIG. 2*a* or 2*b,* the collation controller 216 may receive collation commands in a printer description language (PDL) format, such as printer job language (PJL), printer control language (PCL), or PostScript (PS) commands.

Figure 3:
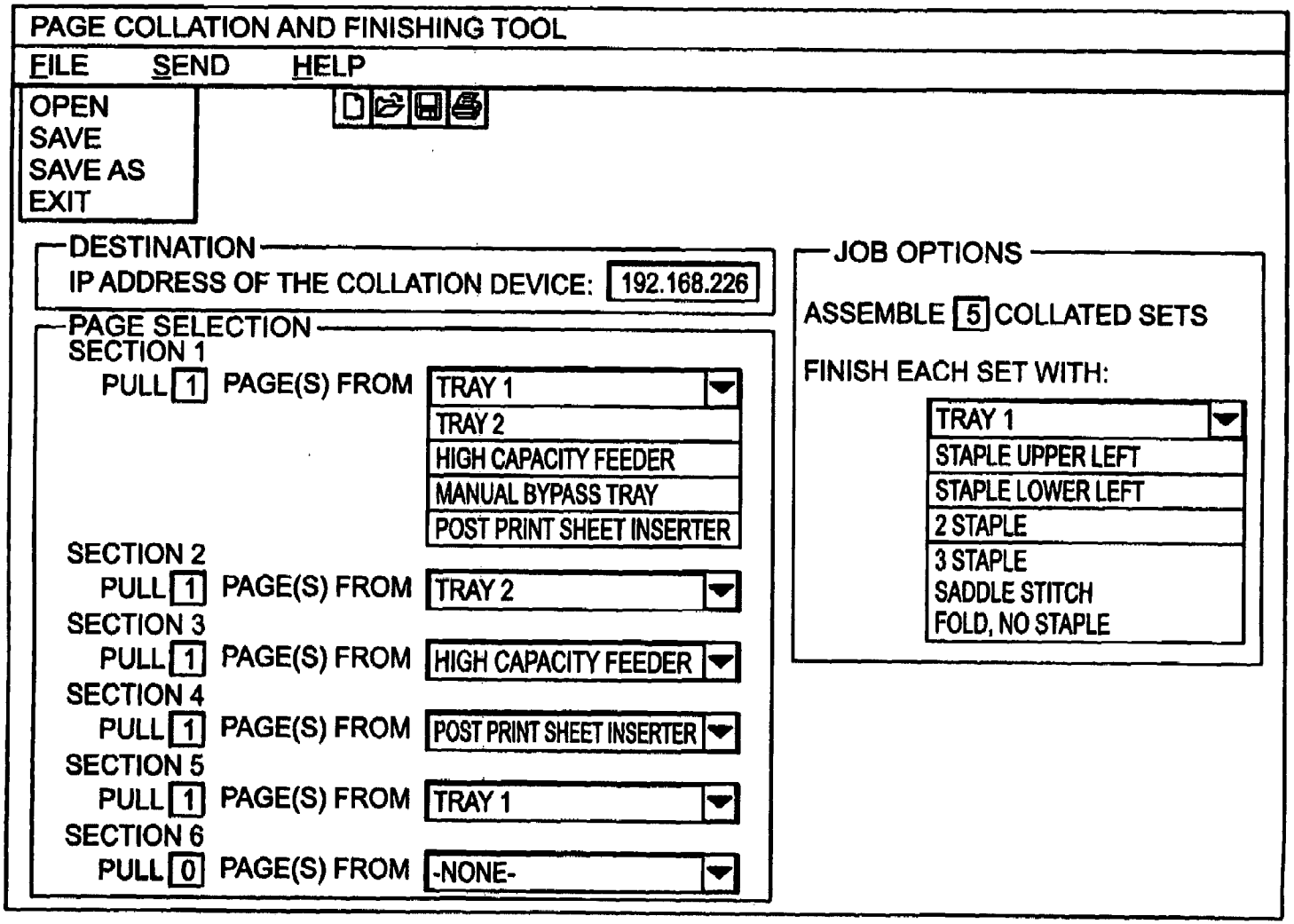
FIG. 3 is an exemplary collation menu, as might be used with the present invention collation driver application.

FIG. 3 is an exemplary collation menu, as might be used with the present invention collation driver application. As shown, the menu can be used to identify a printer. In this example an IP address is used for identification. The menu can also be used to select the order of the input trays, the number of pages pulled, the total number of collation sets, and other finishing options such as stapling. That is, the collation driver application presents collation menu options chosen from the group including the number of collated documents, the tray order, the number of sheets pulled in response to selecting a tray, and media side. The media side option is analogous to duplex printing, permitting the user to "flip" the media in the input trays in the course of creating a collation job. Other selectable options include stapling, hole punching, and folding. The options available are dependent upon printer capabilities. In one aspect, the collation driver application is a module in a collation-enabled print driver. For example, the collation driver application may be sub-menu in a Windows-type print driver.

Returning to FIG. 2*a,* the printer 200 also comprises a print subsystem 270 having an input to receive media delivered from the input media and an input on line 272 to receive print commands. The print subsystem 270 typically includes a fuser (not shown), assuming a laser printer, for transferring images to the input media in response to the print commands and supplying the imaged media at an output on line (paper path) 276 for delivery to the output media tray. In one aspect of the printer 200, the collation controller 216 has an output on line 272 to supply print commands that selectively disengage the print subsystem fuser. In this manner, the heating element of the fuser can be turned off when preprinted sheets (a document section) are passed through the print subsystem 270.

Alternately, a bypass 280 paper path is shown. The bypass 280 operates to direct document sections (preprinted sheets) around the print subsystem 270. Advantageously, the bypass 280 permits the printer 200 be used to collate with a minimum of print subsystem 270 modifications. However, the bypass 280 is a hardware subsystem that is not used in conventional printers.

In another aspect of the printer 200, documents sections from the input tray can be merged with printed media, or sheets that the print subsystem 270 is creating in real-time, to form a collated document. The sheets created by the print subsystem 270 may be either a print or a copy job. That is, the collation controller 216 sends routing commands to the media routing system 210 to collate document sections from the input media trays 202/204/206 with imaged media generated by the print subsystem 270. In this aspect, the media routing system 210 may incorporate elements of the print subsystem 270, such as document inverters useful in duplex or color printing, to aid in controlling the document order. The print subsystem inversion hardware may be represented by the media routing system 210 shown in phantom with dotted lines, subsequent to the print subsystem 270. Such as arrangement may improve efficiency by permitting the printer to print a plurality of sheets, stockpile the sheets, and insert the sheets in the paper path through the print subsystem 270 when appropriate. This arrangement may also be used to enable to media side selection option, mentioned above.

In this aspect, conventional printer hardware modifications may be desirable to augment the printer's ability to stockpile the real-time printed media. For simplicity a stockpilier assembly 278 is shown associated with a part of the media routing system 210 (formed in phantom with dotted lines) subsequent to the print subsystem 270.

Alternately, the media routing system 210 skips the delivery of preprinted sheets to the print subsystem 270, and supplies blank media when a (real-time) printed sheets is to be merged with the document sections loaded in the input trays.

In another aspect, the output media tray, output tray M (220) for example, accepts a collated document as the result of a first collation job and acts an input tray to supply the collated document via paper path 290 as a document section for a second, subsequent, collation job. In a variation of this aspect, the above-mentioned stockpilier assembly 278 acts as a type on internal output tray that permits a first compilation to be merged with other document sections to form a second compilation.

FUNCTION DESCRIPTION

The present invention is a utility that permits a user to configure a job that makes use of all the collation features available in a printer, without using the imaging features. The invention can be enabled as a personal computer (PC) based application that uses PJL, PCL, and PS to generate dummy jobs, so that preprinted stock that is loaded in the printer can be collated, stapled or otherwise "finished" using whichever finishing options are available in the printer.

1—This feature may be configured and initiated using software from a client PC.

2—Collation Jobs configured at the client computer can be set to remain resident in the printer's internal queue and, thereby, initiated from the control panel once or more times.

3—This function can also be programmed internally on the printer to so that it can be configured on the control panel of the device without requiring a connected client computer.

4—This function can also be programmed on the printer's internal web page so that it can be configured without requiring special software on a client PC.

5—The initiating job can be saved as a .prn file or a proprietary file format and recalled for use as a template or to repeat a collation/finisher routine at a later time.

Figure 4:
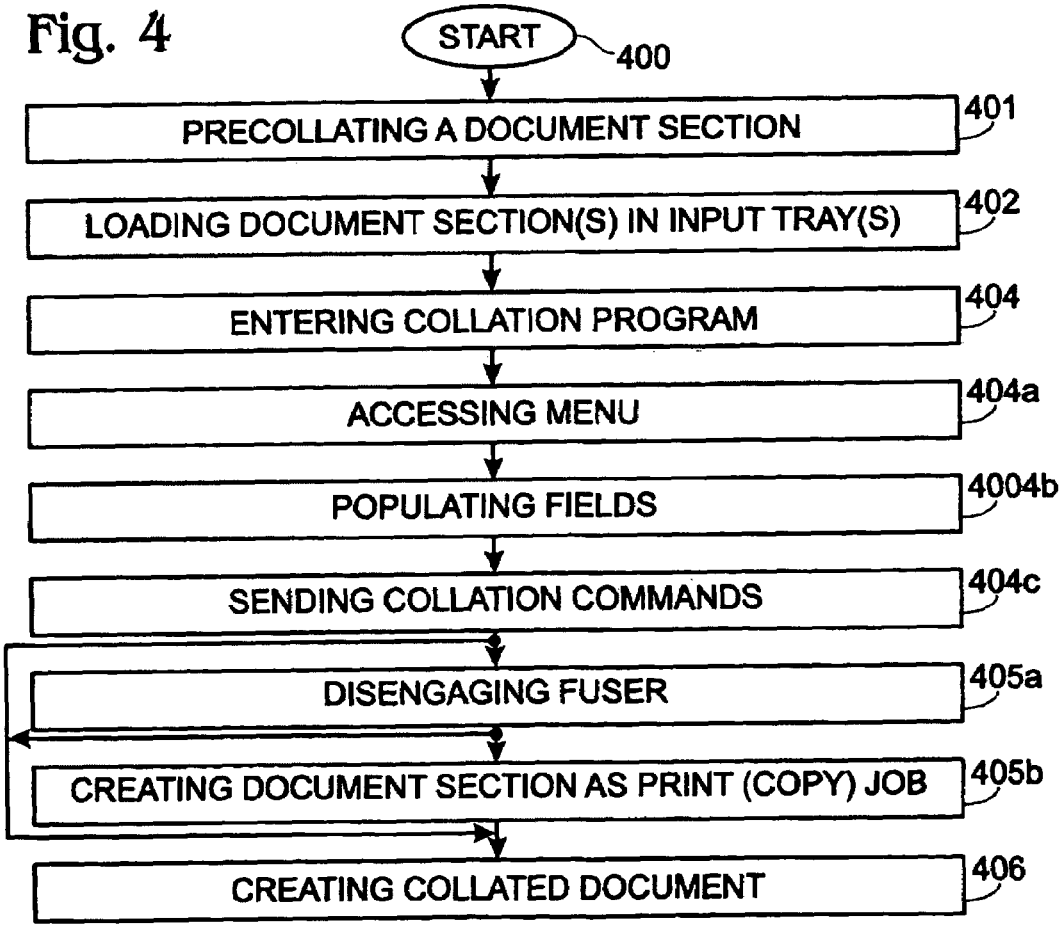
FIG. 4 is a flowchart illustrating the present invention method for using a printer to collate a document from preprinted pages.

FIG. 4 is a flowchart illustrating the present invention method for using a printer to collate a document from preprinted pages. Although the method is depicted as a sequence of numbered steps for clarity, no order should be inferred from the numbering unless explicitly stated. It should be understood that some of these steps may be skipped, performed in parallel, or performed without the requirement of maintaining a strict order of sequence. The method starts at Step 400.

Step 402 loads document sections in at least one printer input media tray. Typically, Step 402 includes loading a plurality of document sections into a corresponding plurality of input media trays. However, only a single input tray is needed if the loaded document section is merged with printed (real-time) document sections. In one aspect Step 402 includes loading either paper and/or plastic sheet mediums. Step 404 enters a collation program. Step 406 creates a collated document from input media tray document sections, in response to the collation program.

In one aspect of the method, entering a collation program in Step 404 includes substeps. Step 404*a* accesses a menu from a collation driver application. Step 404*b* populates fields in the menu. Step 404*c* sends collation commands to a printer collation controller in response to the populated fields. Alternately, Step 404*a* accesses a menu from a collation-enabled print driver. Step 404*b* populates fields in the menu. Step 404c sends print driver commands to a printer controller.

In one aspect, accessing a menu from a collation driver application (Step 404*a*) includes accessing a menu using a user interface (UI) selected from either the front panel of the printer, a client device connected to the printer, or a web page connected to the printer.

In another aspect, sending collation commands to a collation controller (Step 404*c*) includes sending the collation commands in a printer description language (PDL) command format such as PJL, PCL, or PS commands.

One aspect of the method comprises a further step. Step 405*a* disengages a print subsystem fuser. Then, creating a collated document in Step 406 includes routing document sections from the input media tray, through the disengaged fuser.

In a different aspect, Step 405*b* creates at least one document section in response to either a printing or copying selection. Then, Step 406 creates a collated document by combining document sections from the input media tray with the document section created in Step 405*b*.

In another aspect, entering a collation program in Step 404 additionally includes selecting collation options chosen from the group including the number of collated documents, the tray order, the number of sheets pulled in response to selecting a tray, the media side selection, stapling, hole punching, and/or folding. Then, creating a collated document in Step 406 includes created a collated document responsive to the selected options.

Another aspect includes the additional step, Step 401, of precollating a document section with a plurality of different pages. Then, loading document sections in at least one input media tray (Step 402) includes loading the precollated document section. Note that the precollated document section may be a collated document that is a product of Step 406. That is, creating a collated document from input media tray document sections in Step 406 includes creating the precollated document section. Such an option is especially useful for extremely complicated collation jobs or for use with printers having a limited number of input trays.

A printer collating system and method have been provided. Examples have been given of particular uses, menus, and hardware modifications. However, the invention is not necessarily limited to just these examples. Other variations and embodiments of the invention will occur to those skilled in the art.

I claim:

1. A method for using a printer to collate a document from preprinted pages, the method comprising:

loading document sections in at least one printer input media tray;

entering a collation program; and, creating a collated document from input media tray document sections, in response to the collation program.

2. The method of claim 1 wherein loading document sections in at least one input media tray includes loading a plurality of document sections into a corresponding plurality of input media trays.

3. The method of claim 1 wherein entering a collation program includes:

accessing a menu from a collation driver application;

populating fields in the menu; and, sending collation commands to a printer collation controller in response to the populated fields.

4. The method of claim 3 wherein accessing a menu from a collation driver application includes accessing a menu using a user interface (UI) selected from the group including a front panel of the printer, a client device connected to the printer, and a web page connected to the printer.

5. The method of claim 3 wherein sending collation commands to a collation controller includes sending the collation commands in a format selected from the group of printer description language (PDL) commands including printer job language (PJL), printer control language (PCL), and PostScript (PS) commands.

6. The method of claim 1 further comprising:

disengaging a printer fuser; and, wherein creating a collated document includes routing document sections from the input media tray, through the disengaged printer fuser.

7. The method of claim 6 wherein loading document sections in at least one input media tray includes loading media selected from the group including paper and plastic sheets.

8. The method of claim 1 further comprising:

creating at least one document section in response to an action selected from the group including printing and copying; and, wherein creating a collated document includes combining document sections from the input media tray with the created document section.

9. The method of claim 1 wherein entering a collation program includes:

accessing a menu from a collation-enabled print driver;

populating fields in the menu; and, sending print driver commands to a printer controller.

10. The method of claim 1 wherein entering a collation program additionally includes selecting collation options chosen from the group including the number of collated documents, media side selection, the tray order, the number of sheets pulled in response to selecting a tray, stapling, hole punching, and folding; and, wherein creating a collated document includes created a collated document responsive to the selected options.

11. The method of claim 1 further comprising:

precollating a document section with a plurality of different pages; and, wherein loading document sections in at least one input media tray includes loading the precollated document section.

12. The method of claim 11 wherein creating a collated document from input media tray document sections includes creating the precollated document section.

13. A collation-enabled printer for collating a document from preprinted pages, the printer comprising:

at least one input media tray having an interface to accept a document section for loading, and an interface to supply the loaded document section for collation;

a media routing system having an interface to accept media from the input media tray, an input to accept routing commands, and an output to supply a collated document comprising the document sections in an order responsive to the routing commands;

a collation controller having an interface to accept collation commands and an interface to supply routing commands that are responsive to the collation commands; and, at least one output media tray having an interface for receiving the collated document.

14. The printer of claim 13 further comprising:

a plurality of input media trays, for loading a corresponding plurality of document sections.

15. The printer of claim 13 further comprising:

a collation driver application; and, a user interface (UI) selected from the group including a front panel, a connected client device, and a connected web page, the UI accessing a collation menu from the collation driver application and populating fields in the menu in response to user commands, and in response to the collation menu, supplying collation commands to the collation controller.

16. The printer of claim 15 wherein the collation driver application resides in a node selected from the group including the printer, a connected client device, a connected website, and a connected server.

17. The printer of claim 15 wherein the collation controller receives collation commands in a format selected from the group of printer description language (PDL) commands including printer job language (PJL), printer control language (PCL), and PostScript (PS) commands.

18. The printer of claim 15 wherein the collation driver application is a module in a collation-enabled print driver.

19. The printer of claim 15 wherein the collation driver application presents collation menu options chosen from the group including the number of collated documents, media side selection, the tray order, the number of sheets pulled in response to selecting a tray, stapling, hole punching, and folding.

20. The printer of claim 13 further comprising:

a print subsystem having an input to receive media delivered from the input media trays and an input to receive print commands, the print subsystem including a fuser for transferring images to the input media in response to the print commands and supplying the imaged media at an output for delivery to the output media tray; and, wherein the collation controller has an output to supply print commands, to selectively disengage the print subsystem fuser.

21. The printer of claim 20 wherein the input media trays accept document section media selected from the group including paper and plastic sheets.

22. The printer of claim 13 further comprising:

a print subsystem having an input to receive media delivered from the input media trays and an input to receive print commands, the print subsystem transferring images to the input media in response to the print commands and supplying the imaged media at an output for delivery to the output media tray; and, wherein the collation controller sends routing commands to the media routing system to collate document sections from the input media trays with imaged media generated by the print subsystem.

23. The printer of claim 13 wherein the output media tray accepts a collated document as the result of a first collation job and acts an input tray to supply the collated document as a document section for a second, subsequent, collation job.

* * * * *